US009392390B2

(12) United States Patent
Olsen et al.

(10) Patent No.: US 9,392,390 B2
(45) Date of Patent: Jul. 12, 2016

(54) METHOD OF APPLYING A COMBINED OR HYBRID SOUND-FIELD CONTROL STRATEGY

(71) Applicant: Bang & Olufsen A/S, Struer (DK)

(72) Inventors: Martin Olsen, Struer (DK); Martin Bo Møller, Struer (DK)

(73) Assignee: Bang & Olufsen A/S, Struer (DK)

( * ) Notice: Subject to any disclaimer, the term of this patent is extended or adjusted under 35 U.S.C. 154(b) by 58 days.

(21) Appl. No.: 14/381,089

(22) PCT Filed: Mar. 14, 2013

(86) PCT No.: PCT/EP2013/055249
§ 371 (c)(1),
(2) Date: Aug. 26, 2014

(87) PCT Pub. No.: WO2013/135819
PCT Pub. Date: Sep. 19, 2013

(65) Prior Publication Data
US 2015/0043736 A1 Feb. 12, 2015

(30) Foreign Application Priority Data

Mar. 14, 2012 (DK) ..... 2012 00189
Jan. 10, 2013 (DK) ..... 2013 00015

(51) Int. Cl.
*H04S 3/00* (2006.01)
*H04S 7/00* (2006.01)

(52) U.S. Cl.
CPC ..... *H04S 7/30* (2013.01); *H04S 2400/11* (2013.01); *H04S 2420/11* (2013.01); *H04S 2420/13* (2013.01)

(58) Field of Classification Search
None
See application file for complete search history.

(56) References Cited

U.S. PATENT DOCUMENTS 6,266,637 B1 * 7/2001 Donovan ..... G10L 13/06 704/258
6,320,113 B1 * 11/2001 Griffin ..... G10D 3/00 84/738
8,724,827 B2 * 5/2014 Hartung ..... H04R 1/403 381/302
9,100,748 B2 * 8/2015 Hartung ..... H04R 1/403 381/302
2003/0142832 A1 * 7/2003 Meerkoetter ..... H04R 29/003 381/59
2004/0047474 A1 * 3/2004 Vries ..... H04R 25/70 381/60

(Continued)

OTHER PUBLICATIONS

Matthew Jones and Stephen Elliot: "Personal Audio With Multiple Dark Zones"; The Journal of the Acoustical Society of America, Dec. 2008, American Institute of Physics for the Acoustical Society of America, New York, NY, US, vol. 124, No. 6, pp. 3497-3506.

(Continued)

*Primary Examiner* — Peter Vincent Agustin
(74) *Attorney, Agent, or Firm* — Harness, Dickey & Pierce, P.L.C.

(57) ABSTRACT

A method of applying a combined control strategy for the reproduction of multichannel audio signals in two or more sound zones, the method comprising deriving a first cost function for controlling the acoustic potential energy, such as on the basis of the Acoustic Contrast Control method and/or the Energy Difference Maximation method, in the zones to obtain acoustic separation between the zones in terms of sound pressure, deriving a second cost function, such as the Pressure Matching method, controlling the phase of the sound provided in the zones, and where a weight is obtained for determining a combination of the first and second cost functions in a combined optimization.

13 Claims, 4 Drawing Sheets

10

(56) References Cited

U.S. PATENT DOCUMENTS

Figure 1:
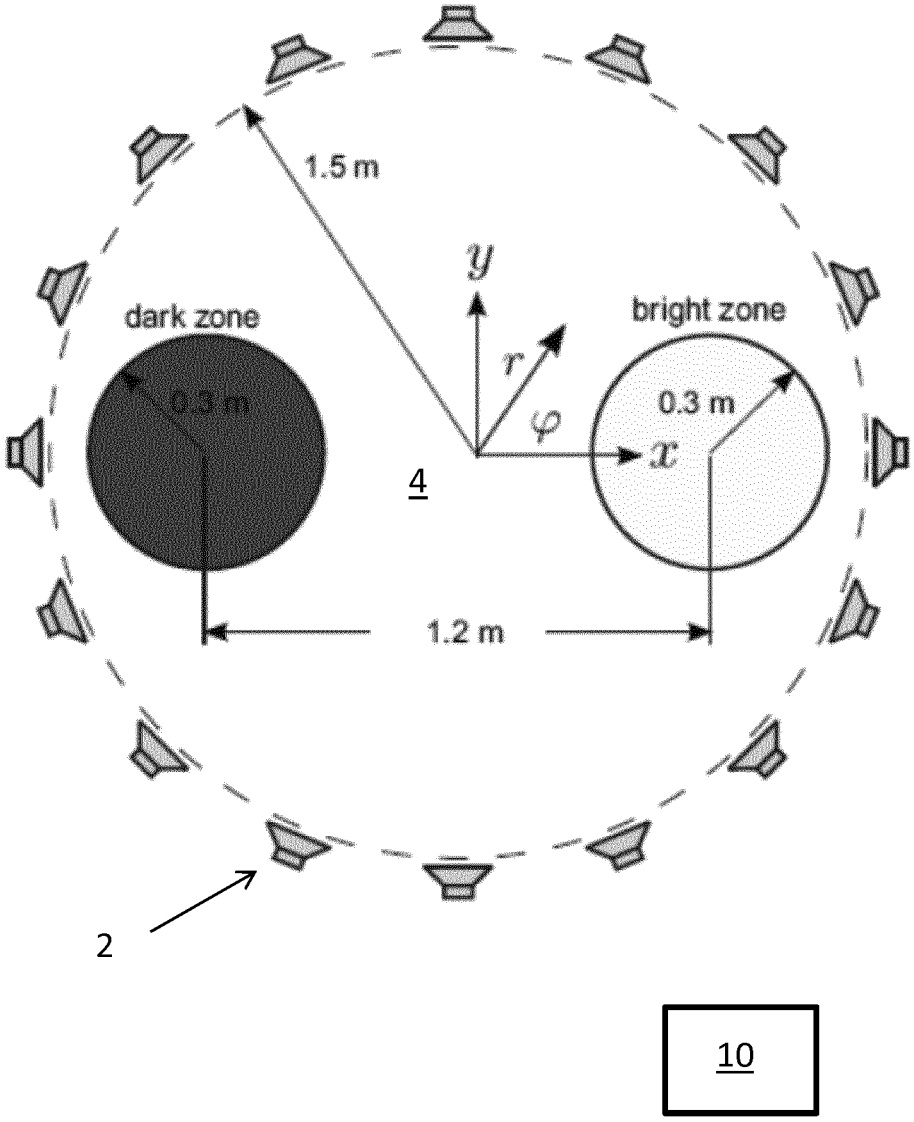

| | | | | |
|---|---|---|---|---|
| 2005/0021539 | A1* | 1/2005 | Short | H04L 9/001 |
| 2006/0029233 | A1* | 2/2006 | Sommerfeldt | G10K 11/1786 381/71.7 |
| 2007/0098183 | A1 | 5/2007 | Enamito et al. | |
| 2008/0049948 | A1* | 2/2008 | Christoph | H04S 7/301 381/86 |
| 2009/0048841 | A1* | 2/2009 | Pollet | G10L 13/07 704/260 |
| 2009/0086990 | A1* | 4/2009 | Christoph | H04R 3/04 381/71.12 |
| 2009/0154723 | A1* | 6/2009 | Choi | H04S 3/002 381/80 |
| 2010/0135503 | A1 | 6/2010 | Shin et al. | |
| 2010/0150361 | A1 | 6/2010 | Kim et al. | |
| 2010/0284544 | A1 | 11/2010 | Kim et al. | |
| 2011/0137661 | A1* | 6/2011 | Morii | G10L 19/008 704/500 |
| 2012/0051568 | A1* | 3/2012 | Kim | H04R 1/403 381/307 |
| 2012/0269349 | A1* | 10/2012 | Seo | H04S 3/006 381/17 |
| 2014/0092710 | A1* | 4/2014 | Farhadiroushan | G01H 9/004 367/117 |
| 2015/0043736 | A1* | 2/2015 | Olsen | H04S 7/30 381/17 |

OTHER PUBLICATIONS

T. Betlehem et al.: "A Constrained Optimization Approach for Multi-Zone Surround Sound", Acoustics, Speech and signal processing (ICASSP), 2011 IEEE International Conference on, IEEE, May 22, 2011, pp. 437-440.

Jacobsen et al.: "A Comparison of Two Strategies for Generating Sound Zones in a Room", Jul. 2011, pp. 1-7.

Shin et al.: "Maximization of Acoustic Energy Difference Between Two Spaces", Journal of the Acoustical Society of America, vol. 128, No. 1, Jul. 2010, pp. 121-131.

P. Coleman et al. "Anechoic Performance, Regularization and Robustness of Sound Field Control Methods Applied to the Sound Zone Problem", Centre of Vison, Speecha nd Signal Processing, Jan. 28, 2013, pp. 1-12.

P. Coleman et al. "Optimising the Panarity of Sound Zones", AES 52$^{nd}$ International Conference, Fuildford, UK, Sep. 2-4, 2013, pp. 1-10.

International Search Report PCT/ISA/210 for International Application No. PCT/EP2013/055249 Dated May 23, 2013.

Danish Patent and Trademark Office Search Report for PA 201200189 dated Oct. 18, 2012.

Written Opinion of the International Searching Authority PCT/ISA/237 for International Application No. PCT/EP2013/055249 dated Mar. 14, 2013.

* cited by examiner

METHOD OF APPLYING A COMBINED OR HYBRID SOUND-FIELD CONTROL STRATEGY

The present invention relates to a manner of providing a hybrid control strategy for deriving a combined model providing a better sound generation in each of a number of sound zones.

The invention relates generally to reproduction and control of audio in sound fields. More specifically a method is disclosed in which a hybrid method introduces a tradeoff between acoustic contrast between two sound zones and the degree to which the phase is controlled in the optimized sound fields.

Optimized sound fields in spatially confined regions can be achieved using multiple control strategies that employ multichannel reproduction techniques. The creation of two spatially separated regions is disclosed in the following, with one first region including low sound pressure (dark zone) and another second region where high sound pressure (bright zone) relative to the first region is reproduced and controlled in some sense according to the control strategy as required.

The strategies often applied to the problem of generating sound zones may roughly be divided into two categories:

optimization methods and sound field synthesis methods.

Advantages of the former include versatility of the spatial source layout and in the number of sources required, with the inherent limitations in performance due to a given configuration. The source configuration in relation to synthesis methods tends to be more constrained, especially in the case of methods like Wave Field Synthesis and Ambisonics.

However, these methods facilitate reproduction of a specific sound field, which enables control of impinging wave fronts in the controlled regions, unlike the energy considerations applied in most numerical optimization methods as in the Acoustic Contrast Control (ACC) and the Energy Difference Maximization method (EDM). Among the above-mentioned categories, control strategies including elements from both synthesis and optimization approaches exist. The Pressure Matching method is an example of this type of control strategy.

Various parameters can be utilized in order to evaluate the performance of the methods, where a dominant metric typically addressed in the literature is the acoustic contrast between two adjacent regions. However, the contrast only states the acoustic separation and does not provide any detailed information about the characteristics of the sound field in each of the optimized regions.

Its known from prior art that control methods providing high acoustic contrast often aggravate the phase control of the resulting optimized sound field due to the nature of the optimization approach, whereas methods synthesizing sound fields, and hence providing high degree of phase control, tend to result in comparatively lower contrast values.

The invention is based on research results documented in the:

Audio Engineering Society—Convention Paper

Presented at the 132$^{nd}$ Convention

2012 Apr. 26-29 Budapest, Hungary

"A Hybrid Method Combining Synthesis of a Sound Field and Control of Acoustic Contrast"

Other manners of providing different sound zones may be seen in: US2010/0135503, Terence Betlehem and Paul D. Teal, "A constrained optimization approach for multi-zone surround sound"; 2011 IEEE International Conference on Acoustics, Speech and Signal Processing (ICASSP), 22 May 2011, IEEE, pages 437-440. Chapter 2 "problem statement", Matthew Jones and Stephen Elliott: "Personal audio with multiple dark zones", The Journal of the Acoustical Society of America, December 2008, American Institute of Physics for the Acoustical Society of America, New York, N.Y., US, vol. 124, no. 6, pages 3497-3506, US2007/0098183 and US2010/0150361.

In the present invention, a hybrid method is proposed combining the high degree of phase control from the synthesis methods with the versatility of the numerical methods into a combined control strategy. The combination of the Energy Difference Maximization and the Pressure Matching method is proposed with the opportunity of controlling the ratio of the importance of acoustic contrast and the degree of phase control. The latter will be evaluated using the resulting reproduction error.

Thus, one aspect of the invention relates to a method applying a combined control strategy, for the reproduction of multichannel sound signals in virtual sound zones, the method comprising:

control the acoustic potential energy in the zones to obtain acoustic separation between the zones in terms of sound pressure, control the acoustic potential energy in each zone, this energy may be seen as being proportional to the mean square sound pressure in a zone, and control the degree of phase control, where the phase control may be evaluated using the resulting reproduction error, where the reproduction error may be controlled in points sampling the bright zone.

The sound fields/-zones may be realized in different geometrical outlines e.g. circular, elliptic, rounded rectangles and alike. The means for proving the audio may be physical sound systems including active loudspeakers physically placed according to the required geometry, or alternatively being virtual created from physical sound systems placed randomly in a given listening domain.

The active sound system configuration includes typically sound transducers (loud speaker unit), with controllable amplifier, -filter and -delay means per loudspeaker device.

In general, the invention relates to a method of applying a combined control strategy for the reproduction of multichannel audio signals in two or more sound zones, the method comprising:

deriving a first cost function for controlling the acoustic potential energy in the zones to obtain acoustic separation between the zones in terms of sound pressure, deriving a second cost function controlling the phase of the sound provided in the zones, where a weight is obtained for determining a combination of the first and second cost functions in a combined optimization.

In this context, a combined control strategy is e.g. a combination of the first and second cost functions into e.g. a combined cost function. The combination, which may also be called a hybrid, has a number of advantages and may be manipulated by choosing the weight.

Applying the strategy may be the deriving of parameters for loudspeakers or other sound providers or amplifiers/filters or the like configured to provide signals to such speakers.

In another situation, the applying step may be the generation of an overall combined cost function which then later on may be used for generating such parameters or signals.

Multichannel audio signals usually will be signals detectable by the human ear and where different signals are output by different speakers. Naturally, the signals may relate to the same overall signals, such as a song, but where the differences between the channels define e.g. a stereo signal or a signal with more channels, such as 4, 5, 6, 7, 9 or more channels.

In this context, a sound zone is a zone wherein a predetermined sound is generated or at least approximated. A zone usually is a predetermined volume of space at a predetermined position, the zone having a predetermined outline or shape or not. Different sound zones may have independently selected sound, such as no sound if desired. Different sound may e.g. be different songs/sources or the same song/source but with different sound volumes.

Any number of sound zones may be selected, such as 2, 3, 4, 5, 6, 8 or more zones if desired. The higher the number of zones, the more speakers will typically be required.

Thus, a distribution or limit is desired between sound energy and the reproduction of a desired sound field is sought.

The first cost function may be proportional to the mean square sound pressure in each zone. Preferably, the proportionality is the same in all zones, so that these may easily be compared.

Separation in this situation may be a high dB value so that no or little sound from one zone may be detected or heard in another zone. Sound pressure is a standard manner of determining the amount of sound present in an area. The separation of the final combined optimization may depend on the weight, which may be selected to optimize other parameters if desired.

The second cost function relates to the phase of the sound provided in one zone or a plurality of zones. Usually, different phases may be used or desired in different zones.

The second cost function may be determined from or relate to a reproduction error from a desired phase or direction of sound, such as from a plane wave in a zone. This reproduction error may be quantified as a difference in angle between an angle of the sound and a predetermined angle and/or a difference between an ideal, plane wave and a planarity of the incoming wave, i.e. how much the sound wave resembles a plane wave.

The weight may be used for determining a weight, in the final optimization, of the first and the second cost functions. The weight, as is described further below, may be determined in a number of manners and may determine the emphasis in the final optimization on the first cost function and thus the acoustical separation, in relation to the second cost function, and thus the phase.

In one embodiment, the first cost function is a cost function of the Acoustic Contrast Control method, and in another embodiment, the first cost function is a cost function of the Energy Difference Maximation method.

In that or another embodiment, the second cost function is a cost function of the Pressure Matching method which may be a manner of minimizing the mean square error between a desired and a reproduced sound field. An alternative to this may be an analytical method based on spherical decomposition of sound fields.

In one embodiment, the step of deriving the first cost function comprises deriving a cost function where the acoustic potential energy in each zone is proportional to the mean square sound pressure in a zone as:

$$E_{pot} \propto \int_{S^2} |p(x)|^2 da(x)$$

In that or another embodiment, the step of deriving the second cost function comprises evaluating the phase control using the resulting reproduction error and to obtain a low reproduction error, the reproduction error being defined as:

$$\varepsilon = \frac{1}{\mathcal{N}} \int_{\mathbb{S}^2} |p^d(x) - p^r(x)|^2 \, da(x), \tag{2}$$

where N is the normalization factor given as $$\mathcal{N} = \int_{S^2} |p^d(x)|^2 da(x). \tag{3}$$

Preferably, the reproduction error is controlled in points sampling a bright zone of the zones, where also a dark zone, i.e. a zone where no sound is desired, exists.

In a preferred embodiment, the weight determining step comprises determining a weight for controlling the tradeoff between the cost functions in the combined optimization. In this situation, the cost functions may be an unconstrained optimization given as:

$$f(q) = q^H(\zeta R_D - R_B)q + \alpha(Gq - p_d)^H(Gq - p^d), \tag{12}$$

Also, in that embodiment, source weights may be calculated from the stationary points where the gradient is zero, and where the stationary points are determined as given:

$$(\zeta R_D - R_B + \alpha G^H G)q = \alpha G^H p^d. \tag{13}$$

In a preferred embodiment, the method further comprises the steps of deriving from the combined optimization, parameters for driving each of a plurality of loudspeakers, driving the loudspeakers in accordance with the derived parameters.

These parameters may be phase shift (delay) parameters, amplification, and/or filtering (typically frequency filtering). Usually, combinations of such parameters are used for each speaker.

It is noted that a speaker may be a physical, real loudspeaker or may be a virtual speaker, the sound from which is actually generated by a number of other, physical speakers, not positioned at the position of the virtual speaker. This is e.g. the effect seen when two speakers output the same signal which then sounds as if coming from a position between the two speakers.

In one embodiment, the step of determining the weight comprises deriving the second cost function so as to have a predetermined maximum reproduction error from a plane wave in a predetermined one of the zones. In one situation, the maximum reproduction error is 15%, but other values, such as 20%, 19%, 17%, 13%, 12%, 10%, 8%, 6%, 4% may be used if desired.

As mentioned above, this reproduction error may be a difference between a direction of a sound wave and a preferred direction and/or a difference between an ideal plane wave and the form of the actual wave.

The weight between the contrast and the phase/direction may be selected in accordance with a number of schemes or in relation to a number of different situations. Clearly, some situations exist where contrast is of more importance, such as when the sound quality of the sound or the quality of the sound providing system is low, so that it may be impossible to obtain a high definition of the phase/angle in the first place. Also, if ambient sound or noise is present, the contrast may not be required to be the top priority, as the surrounding noise anyway will drown any sound carrying over from another zone. In another situation, the phase/angle may be of a higher importance, such as when the listening situation is of importance. In that situation, a lower contrast may be accepted.

In the following, preferred embodiments of the invention will be described with reference to the drawing, wherein:

FIG. 1 illustrates a set-up for a multi-zone audio provider.

Figure 2:
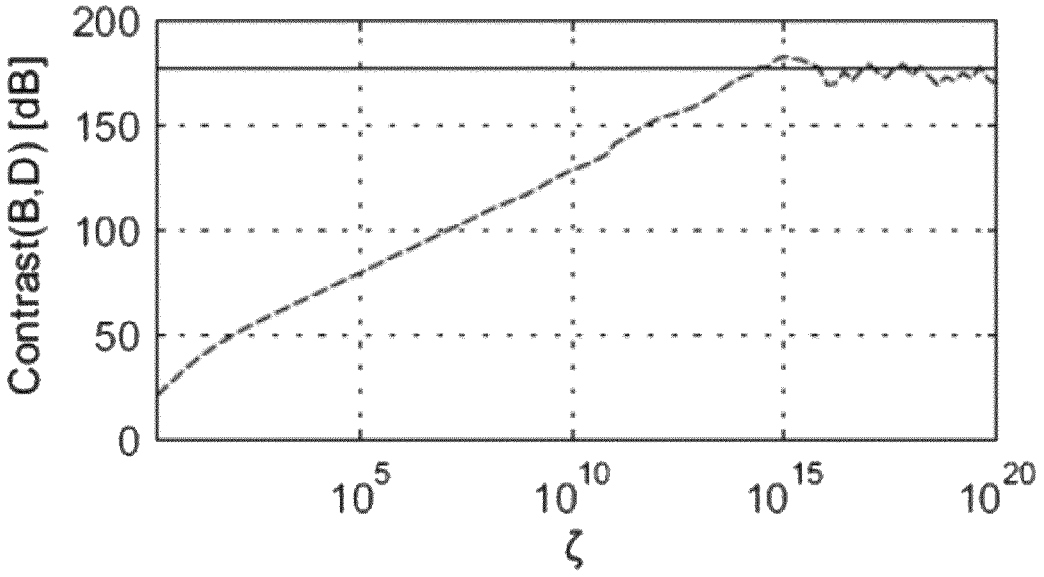
Figure 3:
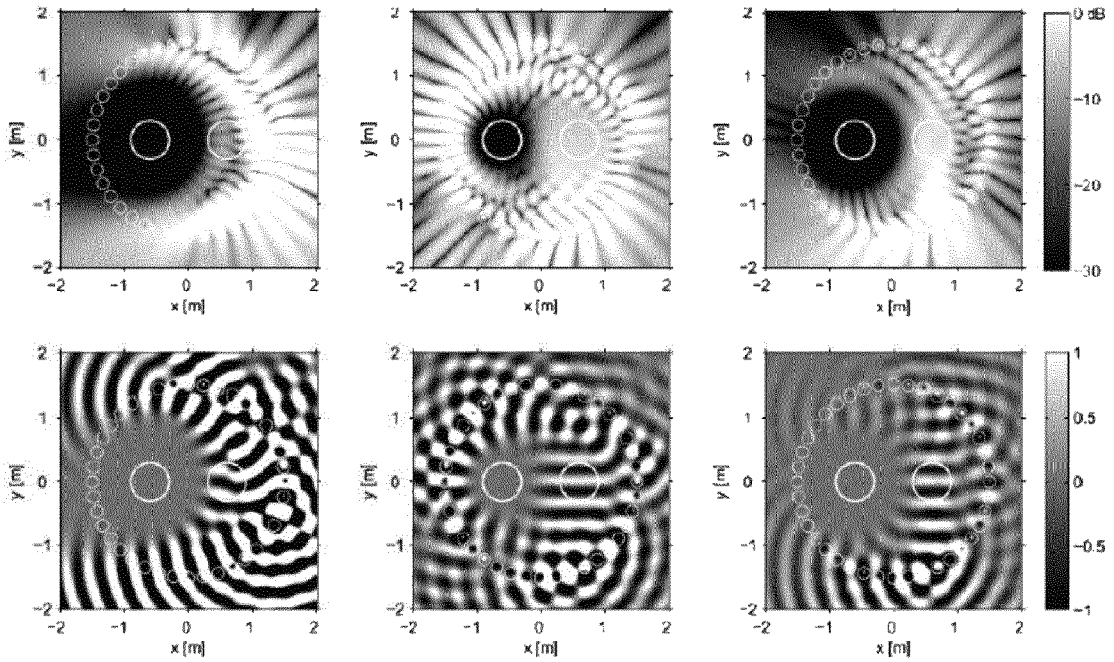
Figure 4:
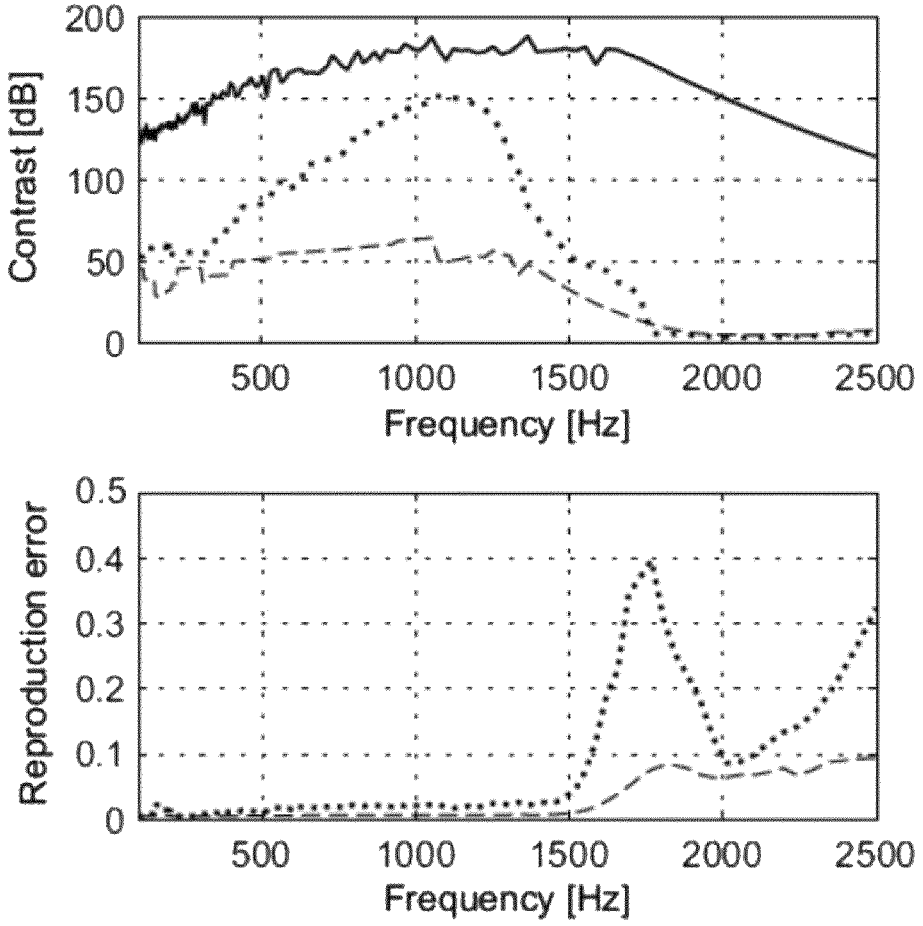

FIG. 2 illustrates the acoustic contrast obtained with EDM at different ζ-values plotted against the contrast obtained by means of ACC, FIG. 3 is a two-dimensional plot of the plane of concern at 1 kHz, where the upper row shows the normalized level and the lower shows the real part of the complex sound field showing the performance of ACC, PM and a preferred embodiment of the hybrid method according to the invention, and FIG. 4 illustrates the acoustic contrast as a function of frequency in the upper plot for all three control strategies and in the lower plot the corresponding reproduction error is found for the Pressure Matching and the hybrid method of FIG. 3.

The applied Metrics to evaluate sound field control may be:

The Acoustic Contrast is defined as the ratio of the average potential energies in the two zones, which is proportional to the average squared pressures in the zones.

This definition can be written as:

$$\text{Contrast}(B, D) = \frac{\int_{\mathbb{S}_B^2} |p(x)|^2 \, da(x)}{\int_{\mathbb{S}_D^2} |p(x)|^2 \, da(x)}, \tag{1}$$

and where p is the sound pressure at position x, $S_B$ and $S_D$ refer to the area of the bright and dark zone, respectively, and da is the differential area element.

The acoustic potential energy in the zones is controlled, this to obtain acoustic separation between the zones in terms of sound pressure. The acoustic potential energy in each zone being proportional to the mean square sound pressure in a zone as:

$$E_{pot} \propto \int_{S^2} |p(x)|^2 da(x)$$

The Reproduction Error is introduced as a metric to evaluate the deviation between a desired $p^d$ and the reproduced sound field $p^r$. In the following the reproduction error is defined as:

$$\varepsilon = \frac{1}{\mathcal{N}} \int_{\mathbb{S}^2} |p^d(x) - p^r(x)|^2 \, da(x), \tag{2}$$

where N is the normalization factor given as:

$$\mathcal{N} = \int_{S^2} |p^d(x)|^2 da(x). \tag{3}$$

The Acoustic Contrast Control (ACC) is an optimization approach that can be applied to generate two separate regions in terms of sound pressure level. The ACC is used to increase the contrast of a desired bright zone with respect to a desired dark zone. To determine the weight for each array element the method requires the transfer functions between sources and the control points in regions where control of the sound field is desired. The unweight response from all sources to the control points of a specific region can be described by means of the spatial correlation between sources and points defined as:

$$R_B = \frac{1}{\mathbb{S}_B^2} \int_{\mathbb{S}_B^2} G(x_s, x)^H G(x_s, x) \, da(x), \tag{4}$$

-continued $$f_{ACC}(q) = \frac{q^H R_B q}{q^H R_D q}, \tag{5}$$

where $(\cdot)^H$ denotes the Hermitian transpose, $G(x_s, x_B)$ is a matrix containing transfer functions from M sources positioned at $x_s$ to the integration point x. The cost function which is optimized through the Acoustic Contrast Control can be defined as the ratio of potential energies in the zones where q is a vector of the volume velocities from each source representing the source weights. Through differentiation with respect to q it is possible to determine the optimal source weights as the eigen-vector of $RD^{-1}RB$, which corresponds to the largest eigen value.

The Energy Difference Maximization closely resembles the Acoustic Contrast Control as this method is also applied to reduce the sound pressure level in one zone with respect to another. The primary difference between the two methods is that EDM is an optimization of the sound energy difference between the zones while ACC is used to optimize the energy ratio. By means of the EDM it is possible to adjust the potential energy difference between the zones in relation to the control effort described by $q^H q$, which results in the EDM cost function:

$$f_{EDM}(q) = \frac{q^H (R_B - \zeta R_D) q}{q^H q}, \tag{6}$$

where ζ is a weight factor. This constant is applied to determine whether the energy distribution should be controlled in the bright or the dark zone to obtain the energy difference. If $\zeta \ll 1$ the optimization focuses the sound energy in the bright zone whereas with $\zeta \gg 1$ the optimization reduces the energy in the dark zone.

The Acoustic Contrast Control and the Energy Difference Maximization are two closely related methods, which both create acoustic spatial separation between two regions in terms of the potential energy distribution.

By using ACC maximizes the acoustic contrast between the two zones which indicates an optimal solution in terms of this metric. Implementing the EDM, on the other hand, optimizes the energy difference subject to a specific preference between bright and dark zone, hence the achieved contrast will depend on the value of the parameter ζ. Application of the EDM includes an additional step of determining the ζ-value that depends on the specific setup of concern.

With implementation of ACC an optimal relationship is determined between constructive interference of sound in the bright zone and destructive interference in the dark zone. As the solution obtained by EDM can be adjusted to rely almost exclusively on constructive interference in the bright zone and destructive interference in the dark zone, it appears reasonable to state that EDM can be applied to obtain results which are similar if not equal to the ACC, assuming correct adjustment of ζ.

This is indicated by FIG. 2 where the acoustic contrast obtained with EDM at different ζ-values is plotted against the contrast obtained by means of ACC. The additional complexity due to the necessity of determining the ζ value seems to make the EDM an unattractive method; however, it has the advantage of eliminating the need for a matrix inversion. To determine the weights through the ACC an inversion of RD is necessary, which can cause numeric instability if the matrix is nearly singular. This problem increases at lower frequencies where the transfer functions from different sources to a control point become similar. The EDM does not include a matrix inversion to determine the source weights; hence it is more robust in terms of such numerical instabilities. This significant difference makes the EDM more suitable as a basis method for the hybrid method, while the ACC is included as a reference of the obtainable acoustic contrast.

Pressure Matching is a procedure that makes it possible to approximate a desired sound field through numerical optimization. The Pressure Matching requires the transfer functions between sources and control points in order to determine the weights for the sources in the array, similar to ACC and EDM.

A hybrid between the sound field control strategies Acoustic Contrast Control and Pressure Matching method is disclosed, originating from the idea that high acoustic contrast desirably should be combined with high degree of phase control inside an optimized spatially confined sound field.

Simulation results for a specific configuration including a bright and dark zone simultaneously reproduced has been examined, with an example of a potential weight determination procedure included.

The hybrid method provides higher contrast compared to the Pressure Matching method over a significant frequency range and at the same time obtains comparable low reproduction error (<3.5%, below 1500 Hz). The performance in contrast of the ACC is superior to both the hybrid and Pressure Matching method, however, at the expense of no phase control in the optimized regions.

The hybrid method provides significantly higher contrast in a wide frequency range without compromising the phase control. The weight determination strategy, on which the simulations presented are based upon, should be considered as only one example among many. Ideally, the weight factors $\alpha$ and $\zeta$, should be optimized in some sense, in order to obtain the best compromise of high contrast and low reproduction error.

The hybrid appears to introduce better performance compared to control strategies that are focusing solely on either achieving high acoustic contrast or achieving low reproduction error of a synthesized sound field.

FIG. 1 illustrates one embodiment of a system configured to use the method of the invention, the system having an equidistant circular array of sources 2, which encompasses the desired sound zones, is applied. The schematic setup of zones and sources is shown using the polar coordinate system. The spatial sound regions to be controlled are inside a circular array of 40 acoustic monopoles. The dark zone refers to a region with low sound pressure relative to the bright zone, where high sound pressure is desired. The system also has a controller or processor 10 configured to receive sound or signals from one or more sources and to generate signals for the speakers 2 in accordance with the method in order to obtain the desired sound in the two zones. This controller may thus have filters, delay circuits and/or amplifiers either for more speakers 2 or individually for each speaker 2. Naturally, each speaker 2 could alternatively have its own amplifier/delay circuit/filter, if desired.

With the circular distribution of sources outside the control zones, it is possible to describe the reproduced sound field within the array as:

$$p^r(r_n, \phi_n) = \sum_{m=1}^{M} q_n \frac{e^{-jk|r_m - r_n|}}{|r_m - r_n|}, \tag{7}$$

where subscript m indicates a given acoustic source whereas n is a control point. The desired sound field at the control points can then be described as:

$$p^d(r_n, \phi_n) = \begin{cases} A_B \dfrac{e^{-jk|r_m - r_n|}}{|r_m - r_n|}, & n = 1, 2, \ldots, N \\ A_D \dfrac{e^{-jk|r_m - r_n|}}{|r_m - r_n|}, & n = N+1, \ldots, L \end{cases}. \tag{8}$$

Here, the bright and dark zones are distinguished by applying different amplitude of the plane wave in the zone (the amplitude of the plane wave in the dark zone is e.g. reduced by 60 dB).

The above equations can be written in matrix notation as:

$$Gq = p^d, \tag{9}$$

where G is the transfer functions given by (7) from the M sources to the N control points, q is the M by 1 vector of source weights, and $p^d$ is the L by 1 vector representing the desired sound field sampled at the control points as defined in (8). When L>M the system is over-determined, and the weights can be determined through minimizing the squared error:

$$f_{pm}(q) = (Gq - p^d)^H (Gq - p^d). \tag{10}$$

The regularized least squares solution can be written as:

$$q_{min} = (G^H G + \delta I)^{-1} G^H p^d, \tag{11}$$

where I is the M by M identity matrix while $\delta$ is the constraint parameter of theTikhonov regularization in the matrix inversion.

In the preferred embodiment of the invention two different categories of sound field control have been introduced: one where the distribution of sound energy is optimized and one where a desired sound field is reproduced with the highest possible accuracy.

As it is desired to control the sound field in terms of both acoustic contrast and synthesis of a desired sound field, the concept of a hybrid method is introduced. Such a hybrid method allows adjustment the available sources to achieve high acoustic contrast and low reproduction error.

The hybrid method is formulated by combining the cost functions from Pressure Matching (10) and Energy Difference Maximization (6) into a single one including a weight for controlling the trade off between the methods in the combined optimization. The array effort constraint $q^H q$ from (6) is not included and the combined hybrid cost function is written as an unconstrained optimization:

$$f(q) = q^H(\zeta R_D - R_B)q + \alpha(Gq - p^d)^H(Gq - p^d), \tag{12}$$

where $\alpha$ is a weight factor between optimization of the acoustic contrast and the reproduction error. In order to include terms representing both EDM and Pressure Matching, the sign of the EDM cost function (6) is changed.

This is done because the terms in the combined cost function should converge in the same direction and Pressure Matching relies on minimizing the deviation between desired and reproduced sound field.

As optimization of the contrast is included in the cost function, it is unnecessary for the Pressure Matching term in the hybrid method to include control points in the dark zone, where the main criterion is low sound pressure level rather than accurate wave front reproduction. Therefore, the Pressure Matching control points in the hybrid method only include points in the bright zone in order to reduce the restrictions on the solution. To calculate the source weights it is necessary to determine the stationary points where the gradient of (12) is zero. Through differentiation with respect to q, the stationary points can be determined as solutions to the matrix equation:

$$(\zeta R_D - R_B + \alpha G^H G)q = \alpha G^H p^d. \quad (13)$$

The above equation has the form of a general Ax=B matrix equation, which can be solved in various ways. A typical one is the pseudo inverse of A including Tikhonov regularization, $x=(A^H A-\delta I)^{-1} A^H B$. In order to determine the regularization parameter $\delta$ it might be suitable to apply the concept of L-curve regularization.

FIG. 2 displays the Acoustic contrast obtained with Energy Difference Maximization at different values of the control factor $\zeta$. The performance obtained by the Acoustic Contrast Control is included for reference. The values are obtained at 1 kHz for the configuration shown in FIG. 1.

Experimental data are disclosed, the data related to a simulation of one embodiment of the invention. The simulation was conducted under anechoic conditions and without any scattering elements. The EDM, ACC, and the proposed hybrid method were implemented with a 3D acoustic monopole simulation and evaluated in the plane coinciding with a circular source array of radius 1.5 m and sound zone radius of 0.3 m. Simulations employing 40 equidistant monopoles were made at different frequencies in the range 100-2500 Hz. The acoustic contrast was evaluated as well as the reproduction error, where the latter was only applied for the EDM and hybrid method due to the fact that no desired phase characteristics are implied in the ACC. A plane wave with propagation direction −90° was defined as the desired sound field to be synthesized in the bright zone in the case of the Pressure Matching and the hybrid method. A plane wave field was chosen only for the sake of simplicity; in theory one can optimize for obtaining an arbitrary sound field. The performance obtained by the hybrid method relies on determination of the two weight factors $\alpha$ and $\zeta$.

For the simulations the following procedure was applied:

(1) As a basis for the contrast performance $\zeta$ is adjusted to obtain a contrast no less than 0.9 of the contrast achieved using ACC.

(2) To obtain the desired control of the sound field in the bright zone $\alpha$ is adjusted in order to achieve a reproduction error below 8 times the resulting error found with the Pressure Matching method.

In both step (1) and (2) the weights are determined iteratively with a maximum number of steps, and inherently, if the desired performance cannot be achieved, the procedure continues with the result obtained at the maximum step limit.

FIG. 3 displays two-dimensional plots of the plane of concern at 1 kHz, where the upper row shows the normalized level and the lower shows the real part of the complex sound field showing the performance of ACC, PM and the hybrid method when generating a bright and a dark zone each with a radius of 0.3 m and a separation distance of 1.2 m at 1 kHz. An array of 40 three-dimensional monopole sources on a circle of 1.5 m was simulated. The surface plot is showing the plan coinciding with the source array. Left column: ACC, Contrast (B,D)=149 dB; centre column: PM, Contrast (B,D)=62 dB, $\zeta$=0; right column: the hybrid method, Contrast (B,D)=149 dB, $\zeta$=0.02. It is apparent that the ACC and the hybrid method provide higher contrast compared to the Pressure Matching.

The dark regions on the level plots are seen to spatially extend further and the low sound pressure extends far beyond the predefined regions. For the ACC the dark region is found to nearly overlap the space of the bright zone introducing spatial variations across this area, which is highly unintended. Both the Pressure Matching and the hybrid method provide more even distribution of sound energy in the bright zone.

The wave fronts found for the ACC appear not to be controlled in any particular sense, as expected. For the two remaining strategies, the desired plane wave field appears to be correctly synthesized.

FIG. 4 displays the acoustic contrast as a function of frequency is shown in the upper plot for all three control strategies and in the lower plot the corresponding reproduction error is found for the Pressure Matching and hybrid method.

The highest contrast performance is achieved using the ACC in the entire frequency band of concern.

The hybrid method performs better compared to the Pressure Matching method below approximately 1750 Hz in the given configuration and appears to converge towards the Pressure Matching method at higher frequencies.

The resulting contrast obtained with the hybrid drops rapidly above 1200 Hz, where the main effort is focused on preserving a low reproduction error rather than high contrast, since optimum including both high contrast and low reproduction error seems unachievable in this frequency interval.

Significant fluctuation in reproduction error of the hybrid may be found above 1500 Hz; hence the error of the reproduced sound field may not converge towards that of the Pressure Matching as was found for the contrast. This could indicate that the endpoints of the hybrid optimization do not completely reach the points of the two most extreme ends of the formulated optimization, namely the ACC and the Pressure Matching, as might be expected.

The invention may be applied in domains in which enabling—and control—of individual sound zones is relevant. These sound zones being e.g. in private domains, such as a house, a car, a boat or public domains like trains, airplanes, shops, warehouses, exhibition halls, airports and the like.

The system may have one or more microphones 4 (FIG. 1) for setting up the model and deriving the parameters and/or for permanent or intermittent use, when parameters are to be altered or the listening space, furnitures, listening position(s), zone positions, speaker positions or the like are altered.

To obtain useful sound zones there preferably are strong requirements to the level of "sound isolation" among the one or more sound zones as defined. Thus, listener in one zone preferably is not disturbed by sound/noise from another zone.

The invention claimed is:

1. A. method of applying a combined control strategy to reproduce multichannel audio signals in two or more sound zones, the method comprising:

deriving a first cost function for controlling an acoustic potential energy in the zones to obtain acoustic separation between the zones in terms of sound pressure;

deriving a second cost function controlling a phase of sound provided in the zones;

combining the first cost function and the second cost function based on a weight to obtain a combined optimization; and driving a plurality of loudspeakers based on the combined optimization.

2. The method according to claim 1, wherein the first cost function is a cost function of an Acoustic Contrast Control method.

3. The method according to claim 1, wherein the first cost function is a cost function of an Energy Difference Maximation method.

4. The method according to claim 1, wherein the second cost function is a cost function of a Pressure Matching method.

5. The method according to claim 1, wherein the deriving the first cost function comprises:

deriving a cost function where an acoustic potential energy in each zone is proportional to the square sound pressure in a zone as:

$$E_{pot} \propto \int_{S^2} |p(x)|^2 da(x)$$

6. The method according to claim 1, wherein the deriving the second cost function comprises:

evaluating phase control using a reproduction error to lower the reproduction error, the reproduction error being defined as:

$$\varepsilon = \frac{1}{\mathcal{N}} \int_{S^2} |p^d(x) - p^r(x)|^2 \, da(x), \tag{2}$$

where N is a normalization factor given as $$\mathcal{N} = \int_{S^2} |p^d(x)|^2 da(x). \tag{3}$$

7. The method according claim 6, where the reproduction error is controlled in points sampling a bright zone.

8. The method according claim 7, the combining the first cost function and the second cost function comprises:

combining cost functions from Pressure Matching and Energy Difference Maximization into a single cost function including a weight for controlling a tradeoff between the pressure matching and the energy difference maximization in the combined optimization.

9. The method according claim 8, where the cost functions are an unconstrained optimization given as:

$$f(q) = q^H(\zeta R_D - R_B)q + \alpha(Gq - p^d)^H(Gq - p^d). \tag{12}$$

10. The method according claim 8, where the source weights are calculated from stationary points where a gradient is zero, and where the stationary points are determined as given:

$$(\zeta R_D - R_B + \alpha G^H G)q = \alpha G^H p^d. \tag{13}$$

11. The method according to claim 1, further comprising:

deriving from the combined optimization, parameters for driving each of the plurality of loudspeakers, wherein the driving drives the loudspeakers in accordance with the derived parameters.

12. The method according to claim 1, further comprising:

determining the weight by deriving the second cost function so as to have a maximum reproduction error from a plane wave in one of the zones.

13. The method according to claim 12, wherein the maximum reproduction error is 15%.

* * * * *